US011857141B2

(12) United States Patent
No

(10) Patent No.: US 11,857,141 B2
(45) Date of Patent: Jan. 2, 2024

(54) VACUUM CLEANER AND CONTROL METHOD THEREOF

(71) Applicant: LG ELECTRONICS INC., Seoul (KR)

(72) Inventor: Hyohoun No, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 56 days.

(21) Appl. No.: 17/116,322

(22) Filed: Dec. 9, 2020

(65) Prior Publication Data

US 2021/0169290 A1 Jun. 10, 2021

(30) Foreign Application Priority Data

Dec. 10, 2019 (KR) ..... 10-2019-0163613

(51) Int. Cl.
*A47L 9/28* (2006.01)
*A47L 5/22* (2006.01)
*A47L 9/02* (2006.01)

(52) U.S. Cl.
CPC ..... *A47L 9/2857* (2013.01); *A47L 5/225* (2013.01); *A47L 9/2831* (2013.01);
(Continued)

(58) Field of Classification Search
CPC ..... A47L 9/2857; A47L 5/225; A47L 9/2831; A47L 9/2842; A47L 9/02; A47L 9/28–2894
(Continued)

(56) References Cited

U.S. PATENT DOCUMENTS

2012/0030898 A1* 2/2012 Crouch ..... A47L 9/22 15/344
2019/0216282 A1* 7/2019 Pohlman ..... A47L 9/28
2019/0248007 A1 8/2019 Duffy et al.

FOREIGN PATENT DOCUMENTS

JP 2016-106701 A 6/2016
JP 2016106701 A * 6/2016
(Continued)

OTHER PUBLICATIONS

International Search Report and Written Opinion in corresponding application PCT/KR2020/015993, dated Mar. 12, 2021 (3 pages).
(Continued)

*Primary Examiner* — Eric J Rosen
*Assistant Examiner* — Tyler James McFarland
(74) *Attorney, Agent, or Firm* — Birch, Stewart, Kolasch & Birch, LLP

(57) ABSTRACT

A method of providing customized cleaning information, a vacuum cleaner, and a control method thereof are disclosed. The method of providing customized cleaning information includes obtaining information related to a cleaning module from a sensor of a vacuum cleaner, determining whether the cleaning module is in use among pre-registered cleaning modules based on the information related to the cleaning module, storing last used time information of the cleaning module based on the information related to the cleaning module, obtaining current time information, comparing the last used time information with the current time information to determine whether unused time of the cleaning module exceeds an unused time threshold specified for the cleaning module, and providing an indication that the cleaning module needs to be used when the unused time of the cleaning module exceeds the unused time threshold.

16 Claims, 15 Drawing Sheets

(52) U.S. Cl.
CPC ..... *A47L 9/2842* (2013.01); *A47L 9/2873* (2013.01); *A47L 9/2894* (2013.01); *A47L 9/02* (2013.01)

(58) Field of Classification Search
USPC ..... 15/319
See application file for complete search history.

(56) References Cited

FOREIGN PATENT DOCUMENTS

| | | | | |
|---|---|---|---|---|
| JP | 2019-113897 | A | | 7/2019 |
| JP | 6566633 | B2 | | 8/2019 |
| KR | 10-2015-0090476 | A | | 8/2015 |
| KR | 10-1701339 | B1 | | 2/2017 |
| KR | 101701339 | B1 | * | 2/2017 |
| KR | 10-2017-0112911 | | | 10/2017 |
| KR | 10-2017-0126377 | | | 11/2017 |
| KR | 10-2019-0131932 | A | | 11/2019 |
| KR | 20190131932 | A | * | 11/2019 |
| TW | M49518 | U | | 2/2015 |
| TW | I627932 | B | | 7/2018 |

OTHER PUBLICATIONS

Office Action issued in Taiwanese Application No. 109140149, dated Aug. 16, 2021 (11 pages).

* cited by examiner

VACUUM CLEANER AND CONTROL METHOD THEREOF

CROSS-REFERENCE TO RELATED APPLICATION

This application claims the benefit of Korean Patent Application No. 10-2019-0163613 filed on Dec. 10, 2019 the entire disclosure of which is hereby incorporated by reference herein for all purposes.

BACKGROUND

Technical Field

The present disclosure relates to a method of providing customized cleaning information, a vacuum cleaner, and a control method thereof, and more particularly, to a method of providing customized cleaning information and a control method for a vacuum cleaner that performs cleaning by suctioning or wiping away dust or foreign matter from the cleaning target area.

BACKGROUND INFORMATION

In general, cleaners are home appliances that suction small pieces of garbage or dust by suctioning the air using electricity and collecting the garbage and dust in dust bins. Such cleaners are generally called vacuum cleaners.

Such a cleaner may be classified as a manual cleaner, which performs cleaning while the user directly moves the cleaner, and an automatic cleaner, which cleans while driving by itself. The manual cleaner i commonly classified as a canister vacuum cleaner, an upright vacuum cleaner, a hand vacuum cleaner, and a stick vacuum cleaner or the like depending on the type of the cleaner.

In the household cleaners, the canister vacuum cleaner was used a lot in the past, but recently, the hand vacuum cleaner and the stick vacuum cleaner, which improve the convenience of use by providing a dust box and a cleaner body integrally, have been used more commonly.

The canister vacuum cleaner has a main body and a suction port connected by a rubber hose or a pipe and, in some cases, can be used with a brush inserted to the suction port.

The hand vacuum cleaner maximizes portability. While it is lightweight, it is often short in length, which may limit the reach of the vacuum for cleaning. Therefore, it is used to clean local places such as on a desk or sofa or in a car.

The stick vacuum cleaner can be used while standing without requiring the user to bend down. Therefore, it is advantageous for cleaning while moving in a large area. Compared to the hand vacuum cleaner, the stick vacuum cleaner has a longer reach and can clean a wider area. Recently, modular type stick vacuum cleaners have been provided, and they are also used to actively change the cleaner type for various objects.

In addition, recently, the hand vacuum cleaner and the stick vacuum cleaner are provided to be used in combination, so products that improve user convenience have been released.

Korea Patent Publication No. 10-2017-0112911 discloses an improved type of vacuum cleaner, and Korean Patent Publication No. 10-2017-0126377 discloses a vacuum cleaner charging stand that can charge the vacuum cleaner while mounting such a vacuum cleaner. According to the disclosed vacuum cleaner, various types of suction nozzles may be connected to a suction unit.

However, these vacuum cleaners and vacuum cleaner charging stands do not provide customized information. That is, since the vacuum cleaner does not actively provide the user with information related to cleaning, it cannot be used as an Internet of Things (TOT) device, which has recently been applied to home appliances. As used herein, the Internet of Things refers to a technology or environment in which data is sent and received in real time by attaching sensors to objects.

SUMMARY

An object of the present disclosure is to provide a method of providing customized cleaning information for a vacuum cleaner, and a control method of the vacuum cleaner. The disclosed systems and methods recognize a cleaning module that is in use in a vacuum cleaner having modular cleaning modules, and provide recommendations to a user for cleaning using the vacuum cleaner, or suggest washing or replacing the cleaning modules by using time data associated with the cleaning process.

In addition, the present disclosure provides a method of providing customized cleaning information, which includes generating a cleaning pattern of the user by using accumulated cleaning information, and actively providing necessary information according to the cleaning pattern.

In addition, the present disclosure provides a vacuum cleaner that can recognize a cleaning module coupled to the cleaner body.

A method of providing customized cleaning information according to an embodiment of the present disclosure includes obtaining information related to a cleaning module from a sensor of a vacuum cleaner, determining whether the cleaning module is in use among pre-registered cleaning modules based on the information related to the cleaning module, storing last used time information of the pre-registered cleaning modules based on the information related to the cleaning module, obtaining current time information, comparing the last used time information with the current time information to determine whether unused time of the cleaning module exceeds an unused time threshold specified for the cleaning module, and providing information that the cleaning module needs to be started when the unused time of the cleaning module exceeds the unused time threshold. Therefore, the present disclosure can increase convenience of use by suggesting that cleaning of a specific object is necessary to the user when it can be expected that the specific object has not been cleaned within a threshold time period.

In addition, the information related to the cleaning module may include information related to any one or more of current, voltage, load current and torque.

In addition, the method may further include storing usage time information of the pre-registered cleaning modules based on the information related to the cleaning module, determining whether accumulated usage time of the cleaning module exceeds a usage time threshold specified for the cleaning module, and providing information that the cleaning module needs to be managed when the accumulated usage time of the cleaning module exceeds the usage time threshold. Therefore, the present disclosure can actively notify that a washing or other maintenance time of the cleaning module has arrived to maintain the efficiency of the cleaner and to ensure hygienic use of the vacuum cleaner. In addition, the present disclosure can notify in advance that the replacement time of the cleaning module has arrived.

Here, the usage time threshold may include time information that the cleaning module needs to be washed, and the information that the cleaning module needs to be managed may include the information that the cleaning module needs to be washed.

Alternatively, the usage time threshold may include time information that the cleaning module needs to be replaced, and the information that the cleaning module needs to be managed may include the information that the cleaning module needs to be replaced.

In some embodiments, the information that the cleaning module needs to be managed may include one or more of a purchase list and a purchase site link corresponding to the cleaning module.

In addition, the method may further include storing separately last used time information for each usage mode of the pre-registered cleaning module based on the information of the sensor, converting the last used time information of each of the cleaning modules by applying a weight for each usage mode, and storing the last used time information for each of the cleaning modules. Therefore, the present disclosure can be managed independently for each usage mode with different loads on the driver.

In addition, the method may further include generating a cleaning pattern of a user using the last used time information of the stored pre-registered cleaning modules, and providing the generated cleaning pattern information of the user. Therefore, the present disclosure can suggest a necessary cleaning or propose a cleaning schedule to the user.

In addition, the method may further include generating a cleaning pattern of a user through the last used time information and the usage time information of the stored pre-registered cleaning modules, and providing the generated cleaning pattern information of the user, wherein the cleaning pattern information includes scheduling and operating time information of cleaning modules that need to be used. Therefore, the present disclosure can suggest a necessary cleaning or propose a cleaning schedule to the user.

In some embodiments, the cleaning pattern information may include a list presenting an order in which the cleaning modules need to be used, and operation time information of each cleaning module.

In addition, the method may further include displaying on a display of a smart device information that the cleaning module needs to be started through an application on the smart device linked to the vacuum cleaner.

A vacuum cleaner combined with modular cleaning modules according to another embodiment of the present disclosure may include a driver configured to transmit a suction force to the cleaning module; a sensor configured to obtain information of any one or more of current, voltage, load, and torque for the cleaning module in use; a memory configured to store information of pre-registered cleaning modules and last used time information of the cleaning module in use; a processor configured to determine the cleaning module in use by comparing the information of the memory with the information related to the cleaning module; and a first wireless transmitter configured to transmit information related to the cleaning module in use to a server.

In addition, the vacuum cleaner may further include a receiver configured to receive information related to a cleaning module that needs to be started from the server, and an output unit including a display or a speaker configured to provide the information related to a cleaning module that needs to be started.

In addition, the vacuum cleaner may further include a usage mode selection unit configured to provide a plurality of usage modes that vary the suction force of the driver, wherein the memory may store usage time information for each usage mode for the cleaning module in use, and information related to the cleaning module in use transmitted from the first wireless transmitter to the server may include the usage time information for each usage mode.

In some embodiments, the processor may convert information related to the cleaning module by applying a weight for each usage mode for the cleaning module in use and transmit the information to the transmitter.

In addition, the vacuum cleaner may further include a cleaner body configured to be provided with a connecting part detachably coupled to the cleaning module, wherein the connecting part may include a suction line configured to provide suction pressure to the cleaning module, and a second power supply line configured to be connected to a first power supply line of the cleaning module and supply power, wherein the sensor may be connected to the second power supply line to obtain current information.

In addition, the vacuum cleaner may further include a cleaner body configured to be provided with a connecting part detachably coupled to the cleaning module, wherein the connecting part may include a suction line configured to provide suction pressure to the cleaning module, a second power supply line configured to be connected to a first power supply line of the cleaning module and supply power, and a second communication line configured to be connected to a first communication line of the cleaning module and receive information of the cleaning module.

In addition, the vacuum cleaner may further include a cleaner body configured to be provided with a connecting part detachably coupled to the cleaning module, a second wireless transmitter configured to be provided in the cleaning module and transmit information of the cleaning module, and a second wireless receiver configured to be provided in the cleaner body and receive information of the second wireless transmitter, wherein the connecting part may include a suction line configured to provide suction pressure to the cleaning module, and a second power supply line configured to be connected to a first power supply line of the cleaning module and supply power.

According to another embodiment of the present disclosure, a method of providing customized cleaning information may be provided for using a vacuum cleaner combined with modular cleaning modules and a smart device to which an application linked to the vacuum cleaner is installed. According to the disclosed method, the vacuum cleaner obtains information related to the cleaning module from a sensor, and transmits the information to a server through a transmitter, a processor of the server or the vacuum cleaner determines whether the cleaning module is in use among pre-registered cleaning modules based on the information related to the cleaning module, a memory of the server or the vacuum cleaner stores last used time information of the pre-registered cleaning modules based on the information related to the cleaning module, wherein the processor of the server or the vacuum cleaner obtains current time information, compares the last used time information with the current time information to determine whether unused time of the cleaning module exceeds an unused time threshold specified for the cleaning module, and provides information that the cleaning module needs to be started for the smart device when the unused time of the cleaning module exceeds the unused time threshold.

A method of providing customized cleaning information according to the present disclosure, can increase convenience of use by suggesting that cleaning of a specific object is necessary to the user when it can be expected that the specific object has not been cleaned for a time threshold, and provide an IOT environment using the vacuum cleaner product.

In addition, according to at least one of the embodiments of the present disclosure, it may be possible to determine types of modular cleaning modules coupled with the vacuum cleaner, and transmit information such as usage data, load data, and contamination data of the cleaning module to the cleaner body.

In addition, according to at least one of the embodiments of the present disclosure, by managing the accumulated time of the cleaning module, as described above, it may be possible to increase the convenience of use and optimize the efficiency of the vacuum cleaner.

In addition, according to at least one of the embodiments of the present disclosure, by storing a record of each cleaning process and generating a cleaning pattern of the user by analyzing the data, it is possible to actively suggest a part that needs to be cleaned and to provide a cleaning schedule to the user.

DETAILED DESCRIPTION OF THE EMBODIMENTS

Figure 1:
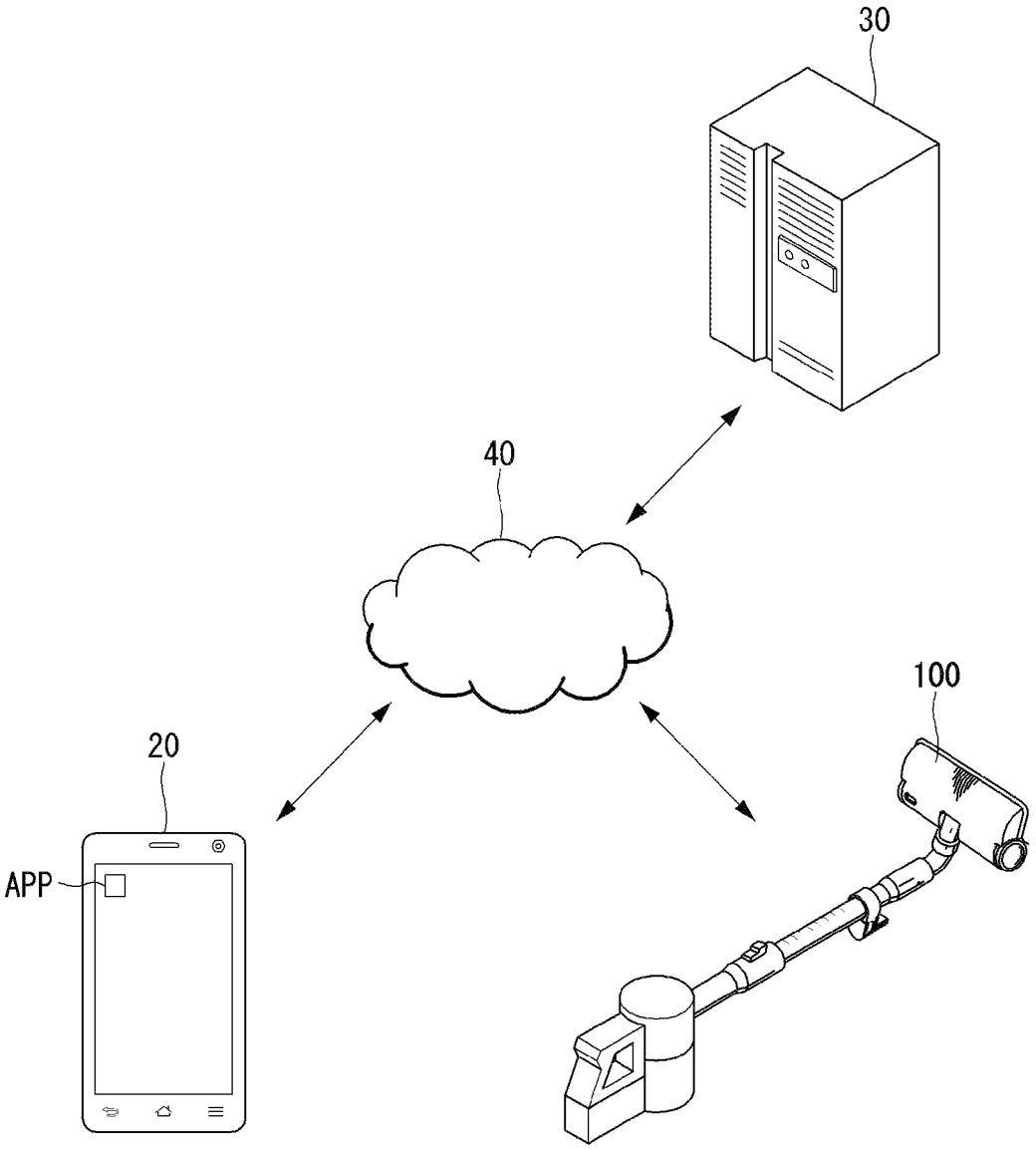
FIG. 1 is a view illustrating a configuration for control of a vacuum cleaner according to an embodiment of the present disclosure.

Hereinafter, with reference to the accompanying drawings, embodiments of the present disclosure will be described in detail. The same or similar components are given the same reference numerals and redundant description thereof will be omitted.

In describing the embodiments disclosed in the present disclosure, when a component is referred to as being "coupled" or "connected" to another component, it may be directly coupled to or connected to the other component, however, it should be understood that other components may exist in the middle.

In addition, in describing the embodiments disclosed in the present disclosure, when it is determined that the detailed description of the related known technology may obscure the gist of the embodiments disclosed in the present disclosure, the detailed description thereof will be omitted. In addition, the accompanying drawings are provided only for easy understanding of the embodiments disclosed in the present disclosure, but the technical spirit disclosed in the present disclosure is not limited by the accompanying drawings, and it should be understood that the accompanying drawings include all changes, equivalents, and substitutes included in the spirit and scope of the present disclosure.

It is to be understood the term "disclosure" may be replaced with terms such as document, specification, description.

Figure 2:
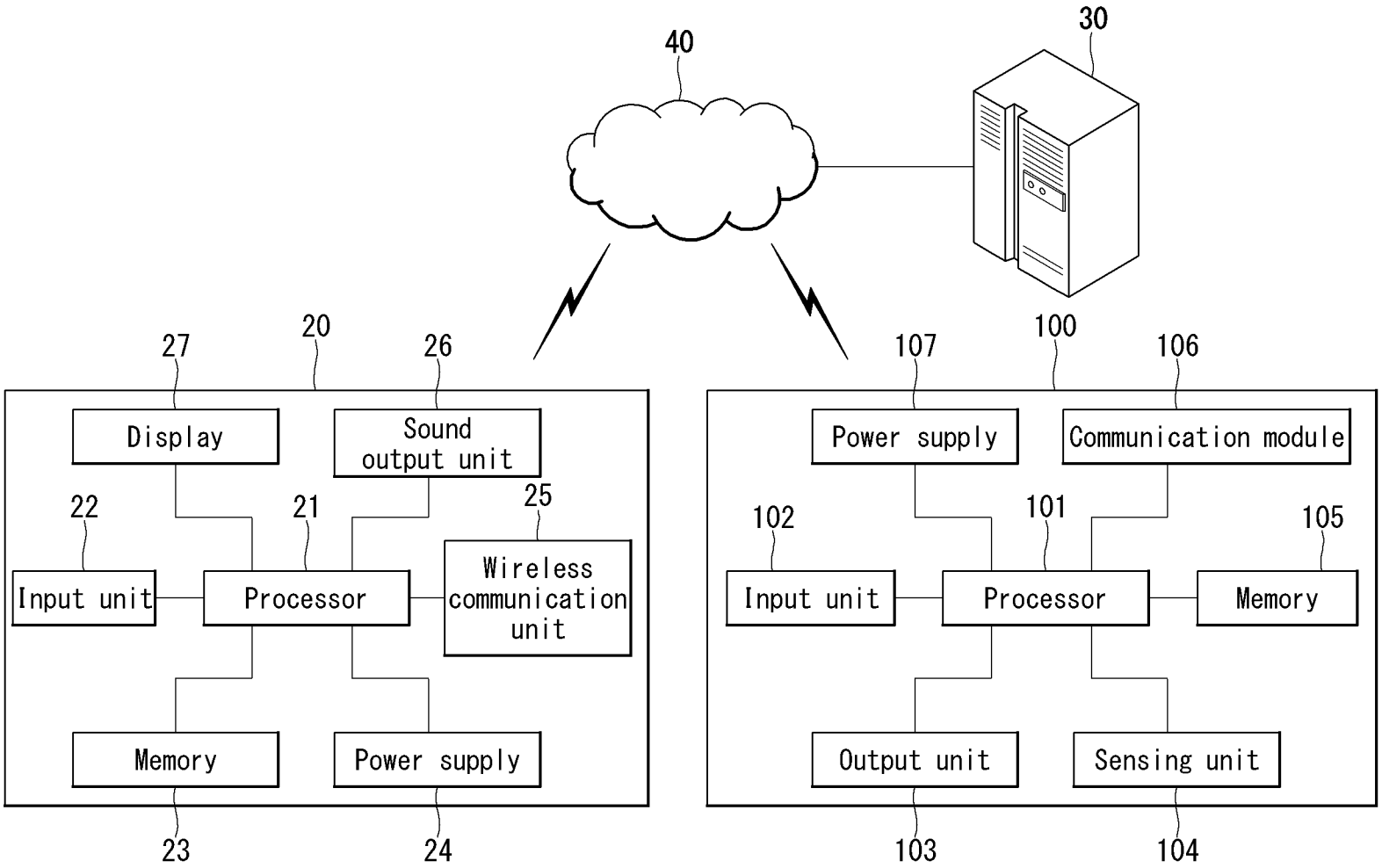
FIG. 2 is a control block diagram of an example control system of a vacuum cleaner and a smart device.

FIG. 1 is a view illustrating a configuration for control of a vacuum cleaner 100 according to an embodiment of the present disclosure, and FIG. 2 is a control block diagram of each component constituting a control system of a vacuum cleaner 100 and a smart device 20.

Referring to FIG. 1, a control system of a vacuum cleaner 100 according to an embodiment of the present disclosure may include a vacuum cleaner 100, a smart device 20 equipped with an application ("app") for controlling or managing the vacuum cleaner 100, a server 30 for managing the application, and a network 40 for communication among the smart device 20, the vacuum cleaner 100, and the server 30.

Referring to FIG. 2, the vacuum cleaner 100 may include a processor 101, an input unit 102, an output unit 103, a sensing unit 104, a memory 105, a communication module 106, and a power supply 107.

The processor 101 may include a controller. For example, it may include a micro controller unit (MCU), although other types of processors are also contemplated.

The input unit 102 may be formed in a control panel provided near a handle of the vacuum cleaner 100, and may be provided in the form of a touch button or a push button. Alternatively, the input unit 102 may be provided in a microphone form to recognize a voice command. In addition, an input unit including a camera or an image sensor may be provided to recognize a gesture of a user.

The output unit 103 may include a display provided as an image output unit and a speaker provided as a sound output unit.

The display may be provided in the control panel or provided as a separate display area, and may include an LCD panel through which an image or a video is output. Alternatively, the display may simply include a singular light emitting unit or a plurality of light emitting units.

The speaker may output a selection sound, a warning sound, a cleaning start or cleaning completion notification signal, or the like. In addition, the speaker may be provided in an area other than the handle that can be grabbed by the user.

The sensing unit 104 may include a current sensor for detecting a current value (or voltage value) of a driver to be described later, a load sensor for detecting a load of the driver, a torque sensor for detecting a torque of the driver, and a timer for detecting an operation time and duration.

The memory 105 may include DRAM (RAM that requires refreshing), SRAM (RAM that does not require refreshing), ROM, EPROM, EEPROM, and the like.

In addition, the communication module 106 may include a wired communication module including a power line communication (PLC) capable of internet communication or a wireless communication module including WI-FI. The communication module 106 may include a transceiver or an antenna. The transceiver may include a transmitter and a receiver.

In addition, the vacuum cleaner 100 may include a power supply 107 and the driver for operating the vacuum cleaner 100. The driver may include a driving motor or a motor pump. The driving motor may include a main driving motor that is installed in a cleaner body to generate a suction force and an auxiliary driving motor that is installed in a suction nozzle provided at a suction end of the vacuum cleaner to generate a rotational force of a roller and the like.

The smart device 20 may include any form of computing device, such as a smart phone that the user can carry. The smart device 20 may include a processor 21, an input unit 22, a memory 23, a power supply 24, a wireless communication unit 25, a sound output unit 26, and a display 27.

The input unit 22 may include various input components, such as a touch type button for inputting a command by touching the display 27.

In addition, the wireless communication unit 25 may be a wireless communication module capable of communicating with through network 40, which may include the internet.

In addition, the sound output unit 26 may include a speaker.

According to the above configuration, the user may execute the application (app) for managing or controlling the vacuum cleaner 100 installed in the smart device 20, and may check a management state of the vacuum cleaner 100 or input a control command through this application. In addition, the user may receive information related to the management state of the vacuum cleaner 100 stored in the server 30 through network 40 to the smart device 20. The control command input to the smart device 20 is transmitted to the server 30 of the application through network 40, and the server 30 may transmit a control command to the communication module 106 of the vacuum cleaner 100 through network 40.

In addition, the control command received through the communication module 106 is received at the processor 101 of the vacuum cleaner 100, and the processor 101 may control the operation of the driver according to the received control command.

In addition, the processor 101 of the vacuum cleaner 100 may transmit an event occurring in the cleaning process and being received from the sensing unit 104 via a wired or wireless signal through the communication module 106. The event information transmitted through the communication module 106 of the vacuum cleaner 100 may be transmitted to the server 30 through network 40. In addition, the server 30 may transmit the received event information to the wireless communication unit 25 of the smart device 20 through network 40.

In addition, the event information received by the wireless communication unit 25 may be displayed on the display 27 by the processor 21 of the smart device 20.

Figure 3:
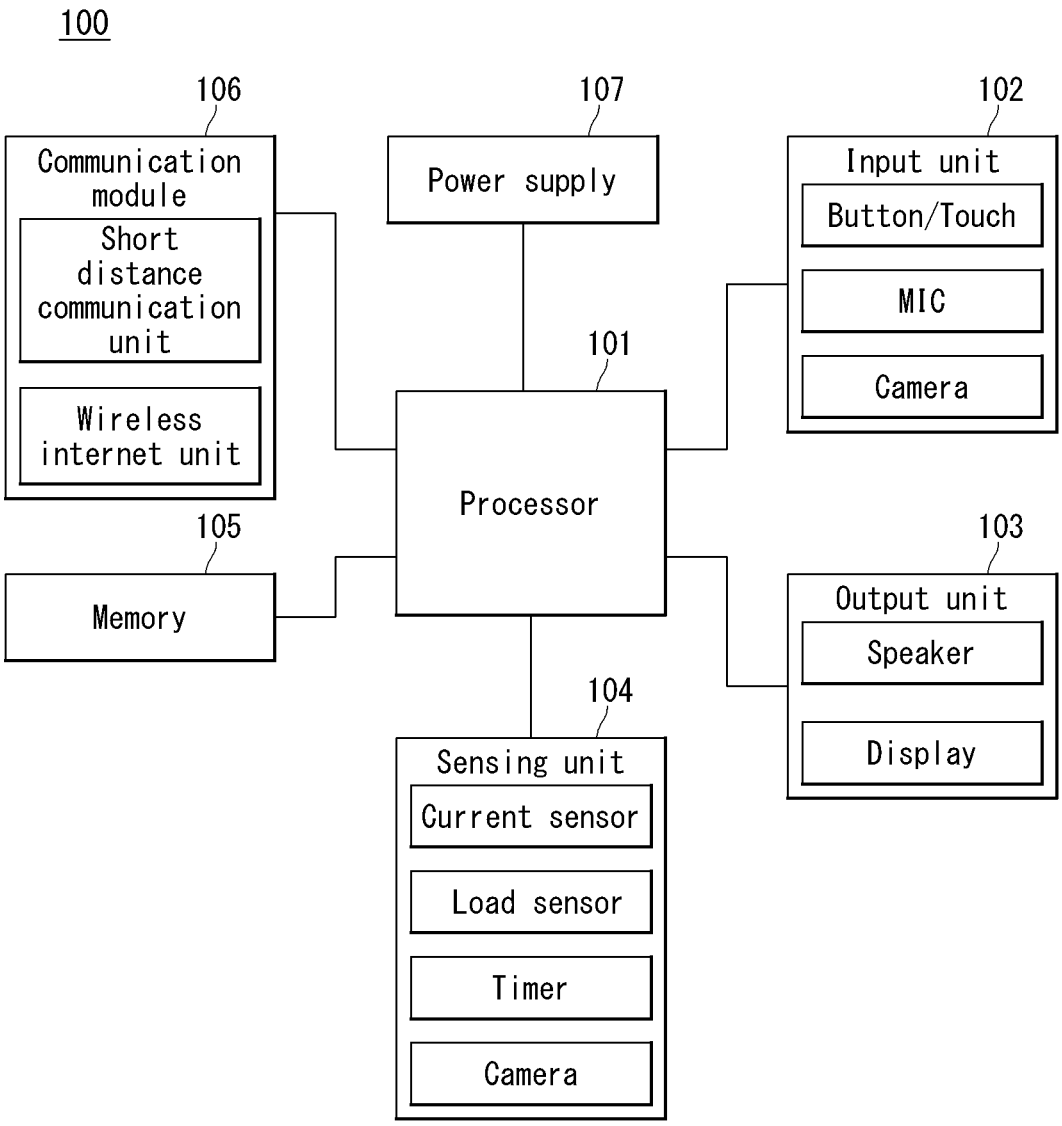
FIG. 3 illustrates an apparatus for providing customized cleaning information according to an embodiment of the present disclosure.

FIG. 3 illustrates a customized cleaning information providing apparatus 100 according to an embodiment of the present disclosure.

Referring to FIG. 3, the customized cleaning information providing apparatus 100 may include a processor 101, an input unit 102, an output unit 103, a sensing unit 104, a memory 105, a communication module 106, and/or a power supply 107.

The processor 101 may include a controller. For example, it may include a micro controller unit (MCU).

The input unit 102 may include a physical button or a touch button that receives a physical signal or a touch signal from outside and a microphone that receives an audio signal based on the control of the processor 101. In addition, the input unit 102 may include a camera or an image sensor that receives an image from outside based on the control of the processor 101.

The output unit 103 may include a speaker that outputs an audio signal based on the control of the processor 101. For example, the speaker may provide the customized cleaning information in a form of the audio signal.

The output unit 103 may include a display for outputting visual information based on the control of the processor 101. The display may implement a touch screen by forming a layer structure or integrally with the touch sensor. The touch screen may function as a user input unit that provides an input interface between the customized cleaning information providing apparatus 100 and the user. For example, the display may obtain information for user registration from the user. The touch screen may further provide an output interface between the customized cleaning information providing apparatus 100 and the user. For example, the display may output the customized cleaning information to the user in the form of visual information. That is, the display may be the input interface of the customized cleaning information providing apparatus 100 and, at the same time, may be the output interface of the customized cleaning information providing apparatus 100.

The sensing unit 104 may include sensors for sensing information of any one or more of a current, a voltage, a load, and a torque of the driver of the customized cleaning information providing apparatus 100. In addition, the sensing unit 104 may include a timer capable of determining an operating time and an operating duration of the driver. In addition, the sensing unit 104 may include a camera or an image sensor to detect the user or an obstacle.

The memory 105 may store data that supports various functions of the customized cleaning information providing apparatus 100. The memory 105 may store a plurality of application programs or applications driven in the customized cleaning information providing apparatus 100, and data and instructions for operating the customized cleaning information providing apparatus 100. At least some of these applications may be downloaded from an external server through wireless communication. In addition, at least some of these application programs may exist on the customized cleaning information providing apparatus 100 from the time of shipment for basic functions (e.g. functions of receiving and transmitting data) of the customized cleaning information providing apparatus 100. On the other hand, the application program may be stored in the memory 105 and installed on the customized cleaning information providing apparatus 100, so that the application program may be driven by the processor 101 to perform an operation (or function) of the customized cleaning information providing apparatus 100.

The communication module 106 may include one or more modules that enable wireless communication between the customized cleaning information providing apparatus 100 and the wireless communication system, between the customized cleaning information providing apparatus 100 and other customized cleaning information providing apparatuses, or between the customized cleaning information providing apparatus 100 and the external server. In addition, the communication module 106 may include one or more modules for connecting the customized cleaning information providing apparatus 100 to one or more networks. In some embodiments, the communication module 106 may be connected to the 5G communication system. The communication module 106 may perform wireless communication with other customized cleaning information providing apparatuses, an external server or an external apparatus (e.g. a mobile terminal) through the 5G communication system.

The communication module 106 may include at least one of a short range communication unit and a wireless internet unit.

As used herein, a wireless internet unit refers to a module for wireless internet access, and may be built in or external to the customized cleaning information providing apparatus 100. The wireless internet unit may be configured to transmit and receive wireless signals in a communication network based on wireless internet technologies.

The wireless internet technologies may include, for example, WLAN (Wireless LAN), Wi-Fi (Wireless-Fidelity), Wi-Fi (Wireless Fidelity) Direct, DLNA (Digital Living Network Alliance), WiBro (Wireless Broadband), WiMAX (World Interoperability for Microwave Access), HSDPA (High Speed Downlink Packet Access), HSUPA (High Speed Uplink Packet Access), LTE (Long Term Evolution), LTE-A (Long Term Evolution-Advanced), etc., and the wireless internet unit may transmit and receive data based on at least one of such wireless internet technologies or through internet technologies not listed above.

If the wireless internet access by WiBro, HSDPA, HSUPA, GSM, CDMA, WCDMA, LTE, LTE-A, etc. is made through a mobile communication network, the wireless internet unit for performing wireless internet access through the mobile communication network may include a mobile communication module.

The short range communication unit may be provided for short range communication, and the short range communication unit may support the short range communication using at least one of Bluetooth, Radio Frequency Identification (RFID), Infrared Data Association (IrDA), Ultra Wideband (UWB), ZigBee, Near Field Communication (NFC), Wireless-Fidelity (Wi-Fi), Wi-Fi Direct, and Wireless Universal Serial Bus (Wireless USB) technology. Such a short range communication unit may support wireless communication between the customized cleaning information providing apparatus 100 and the wireless communication system, between the customized cleaning information providing apparatus 100 and other customized cleaning information providing apparatuses, or between the customized cleaning information providing apparatus 100 and a network in which another mobile terminal (or an external server) is located through wireless area networks. The short range wireless communication networks may be short range wireless personal area networks.

Here, the other customized cleaning information providing apparatus may be an apparatus capable of exchanging (or interlocking) data with the customized cleaning information providing apparatus 100 according to the present disclosure. The short range communication unit, around the customized cleaning information providing apparatus 100, may detect (or recognize) other customized cleaning information providing apparatuses that can communicate with the customized cleaning information providing apparatus 100. Furthermore, when the detected other customized cleaning information providing apparatuses are customized cleaning information providing apparatuses certified to communicate with the customized cleaning information providing apparatus 100 according to the present disclosure, the processor 101 may transmit at least a part of data processed by the customized cleaning information providing apparatus 100 to the other customized cleaning information providing apparatuses through the short range communication unit. Therefore, the user of the other customized cleaning information providing apparatuses may use data processed by the customized cleaning information providing apparatus 100 through the other customized cleaning information providing apparatuses. For example, according to this, the user can receive cleaning information from the customized cleaning information providing apparatus 100, and output the cleaning information through a display of another customized cleaning information providing apparatus 100.

The power supply 107 may receive power from an external power source and an internal power source under the control of the processor 101 to supply power to each component included in the customized cleaning information providing apparatus 100. The power supply 107 may include a battery, which may be a built-in battery or a replaceable battery.

According to an embodiment of the present disclosure, the processor 101 may control the input unit 102, the output unit 103, the sensing unit 104, the memory 105, the communication module 106, and the power supply 107.

According to an embodiment of the present disclosure, the processor 101 may control the input unit 102 and the output unit 103 to provide customized cleaning information.

According to an embodiment of the present disclosure, the processor 101 may control the sensing unit 104 to obtain information necessary for the customized cleaning information providing apparatus 100. For example, the processor 101 may obtain current/voltage values, load values, torque values, operating time and operating duration information, user recognition information, and/or obstacle detection information from the sensing unit 104.

According to another embodiment of the present disclosure, the processor 101 may obtain a plurality of images of a user's face stored in the memory 105, and may generate and/or learn a face classification model for classifying a user's face by using (meta learning) only a predetermined number of images among the plurality of user's face images. In addition, the processor 101 may obtain images of a plurality of food items stored in the memory 105, and may generate/learn a food classification model for classifying food using only a predetermined number of images among the plurality of food images.

According to an embodiment of the present disclosure, the processor 101 may control the communication module 106 to transmit the customized cleaning information to an external mobile terminal.

A detailed description of the function/operation of the processor 101 is provided below.

Figure 4:
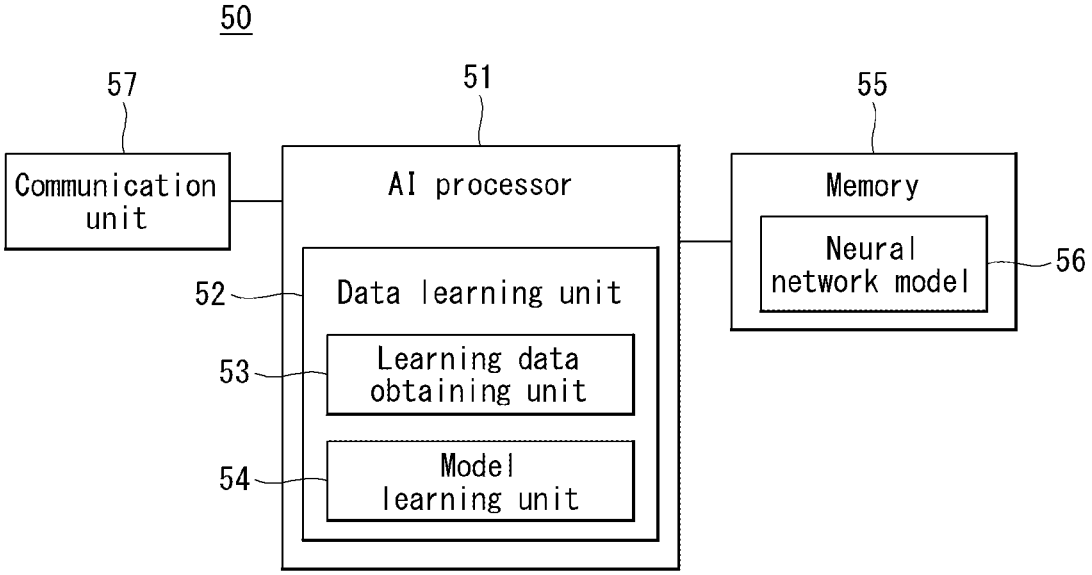
FIG. 4 is a block diagram illustrating an example of a processor of FIG. 3.

FIG. 4 is a block diagram illustrating an example processor of FIG. 3.

As shown in FIG. 4, the processor may be an artificial intelligence ("AI") device 50, but is not necessarily limited thereto.

The AI device 50 may include an electronic device including an AI module capable of performing AI processing or a server including the AI module. In addition, the AI device 50 may be included in at least a part of the customized cleaning information providing apparatus 100 illustrated in FIG. 3 and may be provided to perform at least some of the AI processing.

The AI processing may include all operations related to the control of the customized cleaning information providing apparatus 100 shown in FIG. 3. For example, the customized cleaning information providing apparatus 100 may perform processing/determination and control signal generation through AI processing of the sensing data or the obtained data. For example, the customized cleaning information providing apparatus 100 may control an intelligent electronic device by performing AI processing of the data received through the communication unit.

The AI device 50 may be a client device that directly uses an AI processing result, or a device of a cloud environment that provides the AI processing result to another device.

The AI device 50 may include an AI processor 51, a memory 55, and/or a communication unit 57.

The AI device 50 may be any form of computing device capable of learning neural networks, and may be implemented as various electronic devices such as a server, a desktop PC, a notebook PC, a tablet PC, and the like.

In some embodiments, the AI processor 51 may learn a neural network using a program stored in the memory 55. In particular, the AI processor 51 may learn a neural network for recognizing vehicle-related data. Here, the neural network for recognizing vehicle-related data may be designed to simulate a human brain structure on a computer, and may include a plurality of network nodes having weights, which simulate the neurons of a human neural network. A plurality of network modes may transmit and receive data according to each connection relationship so that neurons simulate the synaptic activity of neurons that transmit and receive signals through synapses. Here, the neural network may include a deep learning model developed from the neural network model. In the deep learning model, the plurality of network nodes may be located at different layers and transmit and receive data according to a convolutional connection relationship. Examples of the neural network models may include various deep learning techniques, such as deep neural networks (DNNs), convolutional deep neural networks (CNNs), recurrent boltzmann machines (RNNs), restricted boltzmann machines (RBMs), and deep belief networks (DBN), and Deep Q-Network, and may be applied to fields such as computer vision, speech recognition, natural language processing, speech/signal processing, and the like.

The processor that performs the AI functions described above may be a general purpose processor (e.g. CPU), or may be an dedicated processor (e.g. GPU) for artificial intelligence learning.

The memory 55 may store various programs and data necessary for the operation of the AI device 50. The memory 55 may be implemented as a nonvolatile memory, a volatile memory, a flash-memory, a hard disk drive (HDD), or a solid state drive (SDD), etc. The memory 55 may be accessed by the AI processor 51, and may read/write/modify/delete/update the data by the AI processor 51. In addition, the memory 55 may store a neural network model (e.g. deep learning model 56) generated through a learning algorithm for data classifying/recognizing according to an embodiment of the present disclosure.

In some embodiments, the AI processor 51 may include a data learning unit 52 for learning the neural network for data classification and/or recognition. The data learning unit 52 may learn a criterion defining what learning data to use to determine the data classification/recognition and how to classify and recognize the data using the learning data. The data learning unit 52 may learn the deep learning model by obtaining the learning data to be used for learning and applying the obtained learning data to the deep learning model.

The data learning unit 52 may be manufactured in a form of at least one hardware chip and mounted on the AI device 50. For example, the data learning unit 52 may be manufactured in a form of a dedicated hardware chip for artificial intelligence (AI), or may be manufactured as a part of a general purpose processor (CPU) or a graphics dedicated processor (GPU) and mounted on the AI device 50. In addition, the data learning unit 52 may be implemented as a software module. When implemented as a software module (or a program module including instructions), the software module may be stored in a computer readable non-transitory computer readable recording media. In this case, at least one software module may be provided by an operating system (OS) or by an application.

The data learning unit 52 may include a learning data obtaining unit 53 and a model learning unit 54.

The learning data obtaining unit 53 may obtain learning data necessary for a neural network model for classifying and recognizing data. For example, the learning data obtaining unit 53 may obtain vehicle data and/or sample data for input to the neural network model as the learning data.

The model learning unit 54 may learn to have a criterion about how the neural network model classifies predetermined data using the obtained learning data. In this case, the model learning unit 54 may learn the neural network model through supervised learning that uses at least some of the learning data as a criterion. Alternatively, the model learning unit 54 may learn the neural network model through unsupervised learning that finds a criterion by self-learning using the learning data without guidance. In addition, the model learning unit 54 may learn the neural network model through reinforcement learning using feedback on whether the result of the situation determination according to the learning is correct. In addition, the model learning unit 54 may learn the neural network model using learning algorithms that include error back-propagation or gradient decent.

When the neural network model is learned, the model learning unit 54 may store the neural network model in the memory. The model learning unit 54 may store the learned neural network model in the memory of the server connected to the AI device 50 through a wired or wireless network.

The data learning unit 52 may further include a learning data preprocessor (not shown) and a learning data selector (not shown) in order to improve analysis results of a recognition model, or to save resources or time required for generating the recognition model.

The learning data preprocessor may preprocess the obtained data so that the obtained data may be used for learning for situation determination. For example, the learning data preprocessor may process the obtained data to present it in a format such that it may be used by the model learning unit 54 for image recognition.

In addition, the learning data selector may select data necessary for learning among the learning data obtained by the learning data obtaining unit 53 or the learning data preprocessed by the preprocessor. The selected learning data may be provided to the model learning unit 54. For example, the learning data selector may select only data for an object included in a specific area as learning data by detecting a specific area of an image obtained through a camera of the intelligent electronic device.

In addition, the data learning unit 52 may further include a model evaluator (not shown) to improve analysis results of the neural network model.

The model evaluator may input the evaluation data into the neural network model, and when the analysis result output from the evaluation data does not satisfy a predetermined criterion, may allow the model learning unit 54 to learn again. In this case, the evaluation data may be predefined data for evaluating the recognition model. For example, among the analysis results of the learned recognition model on the evaluation data, when the number or ratio of evaluation data that is not accurate in analysis results exceeds a preset threshold, the model evaluator may determine that a predetermined criterion is not satisfied.

The communication unit 57 may transmit the AI processing result by the AI processor 51 to an external electronic device.

The external electronic device may include an autonomous vehicle, a robot, a drone, an AR device, a mobile device, a home appliance, and the like.

For example, when the external electronic device is the autonomous vehicle, the AI device 50 may be defined as another vehicle or 5G network device that communicates with the autonomous module vehicle. On the other hand, the AI device 50 may be implemented by being functionally embedded in the autonomous module provided in the vehicle. In addition, the 5G network may include a server or a module that performs autonomous related control.

On the other hand, the AI device 50 illustrated in FIG. 4 has been described to functionally be divided into the AI processor 51, the memory 55, the communication unit 57, and the like, but it should be noted that the above-described components may be integrated into one module and may be referred to as an AI module.

Figure 5:
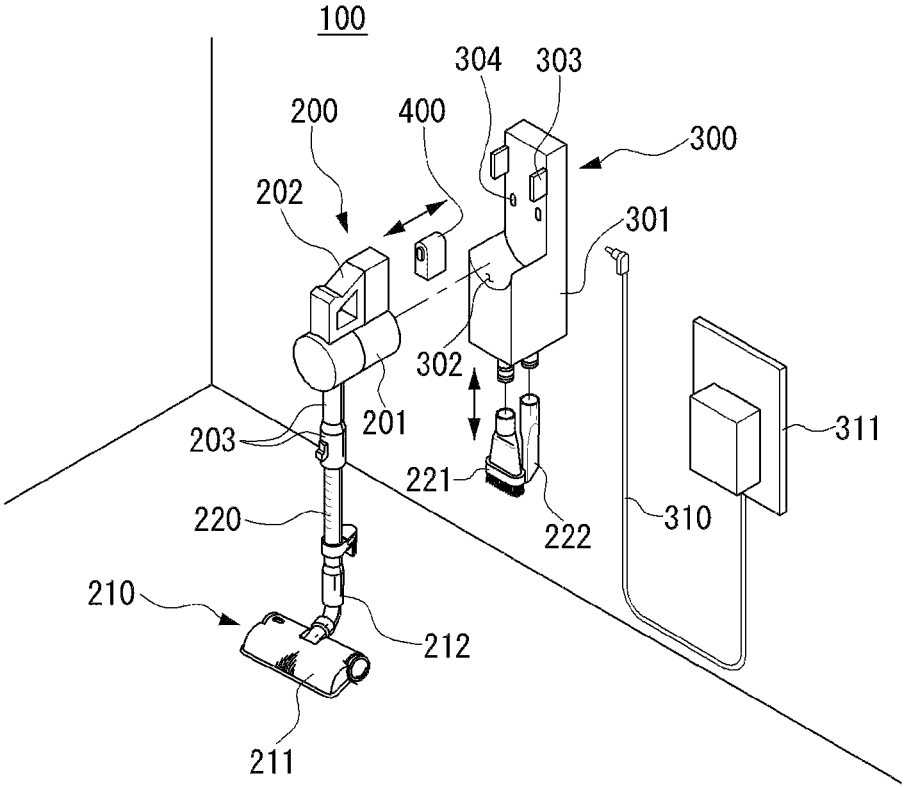
FIG. 5 is an exploded perspective view illustrating a vacuum cleaner according to an embodiment.

FIG. 5 is an exploded perspective view illustrating a vacuum cleaner 100 according to an embodiment.

Referring to FIG. 5, a vacuum cleaner 100 may include a cleaner body 200, a cleaning module 210 coupled to the cleaner body 200, a length adjusting member 220 for connecting the cleaner body 200 and the cleaning module 210, a battery 400 coupled to the cleaner body 200, and a cleaner holder 300 on which the cleaner body 200 is mounted.

The cleaner body 200 may include a body part 201 in which a suction motor (not shown) for generating a suction force and a cyclone flow device (not shown) for separating dust from the suctioned air are installed, a handle part 202 connected to the back of the body part 201 and grabbed by the user, a connecting part 203 connected to the front of the body part 201 and coupled to the cleaning module 210 or the length adjusting member 220.

The cleaning module 210 may include a suction part 211 that suctions dust and the like, and a coupling part 212 coupled to the cleaner body 200 or the length adjusting member 220.

One end of the length adjusting member 220 may be coupled to the cleaner body 200, and the other end of the length adjusting member 220 may be coupled to the cleaning module 210. The length adjusting member 220 may employ a structure in which the length is variable. In some embodiments, the length adjusting member 220 may employ a material that can be elastically changed. The one end of the length adjusting member 220 may be coupled to the cleaner body 200, and a suction part (not shown) may be provided at the other end so that a suction function can be performed without coupling of a separate cleaning module.

The battery 400 may be detachably connected to the body part 201 of the cleaner body 200 to supply power for driving the vacuum cleaner 100. The battery 400 may be detachably connected to a battery accommodating part 302 of the cleaner holder 300 to be rechargeable. Two batteries 400 may be provided. One may be coupled to the cleaner body 200 to supply power, and the other may be coupled to the cleaner holder 300 to be charged.

The cleaner holder 300 may include a stand-type or wall-type body 301, a battery accommodating part 302 in which the battery 400 is charged, a cleaner support part 303 which supports the cleaner body 200, a charging part 304 electrically connected to the battery 400 coupled to the cleaner body 200.

Although the drawing shows a wall-type body 301, it may alternatively include a stand-type body (not shown) provided in a standing state on the floor.

The battery 400 may be electrically connected to the charging part 304 while the cleaner body 200 is supported by the cleaner support part 303. Therefore, the user may charge the battery 400 by placing the cleaner body 200 on the cleaner holder 300.

The cleaner holder 300 may be electrically connected to an external outlet 311 through a power line 310. A current transmitted through the power line 310 may charge a first battery accommodated in the cleaner body 200 through the charging part 304 of the cleaner holder, and charge a second battery mounted on the battery accommodating part 302.

In addition, in the vacuum cleaner 100, a suction part for performing various functions may be modularly mounted on the cleaner body 200. That is, the cleaning module 210 may be provided with a plurality of functions, and the user may use a cleaning module 210 suitable for the desired object to be cleaned in combination with the cleaner body 200.

The cleaning module 210 may include a cleaning module having a basic wood floor suction port, a cleaning module having a bedding suction port, a cleaning module having a mattress suction port, a cleaning module having a carpet suction port, a cleaning module having a mop, or cleaning modules for cleaning various other surfaces. In addition, a dedicated cleaning module for performing various functions, such as for difficult to clean dust, cleaning in gaps, or for cleaning raised objects may be provided as a module.

FIG. 5 shows a cleaning module 221 having a 2-in-1 suction port and a cleaning module 222 having a suction hole for gaps are mounted on the cleaner holder 300. The cleaning module 221 having the 2-in-1 suction port may be used as a basic type of attachment for cleaning a sofa or a mattress and as a brush type when cleaning a frame or furniture by adjusting the length of the brush by button operation. In addition, the cleaning module 222 having the suction hole for gaps may have an inlet formed in a narrow nozzle shape to be advantageous for suctioning dust and the like by inserting the nozzle into a narrow gap.

Figure 6:
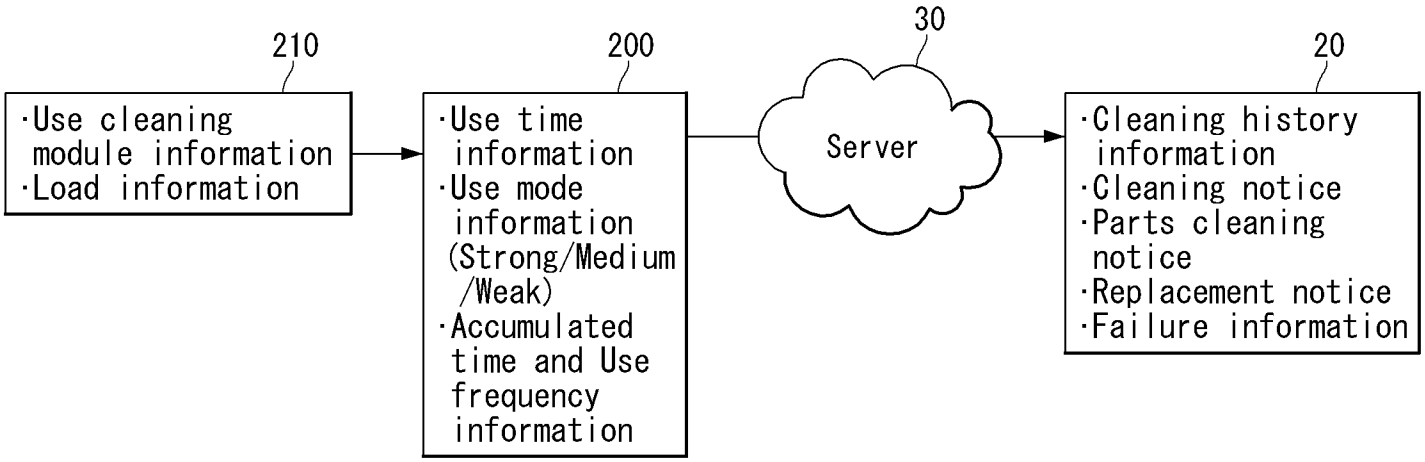
FIG. 6 is a diagram illustrating a control method of a vacuum cleaner according to an embodiment.

FIG. 6 is a diagram illustrating an example control method of a vacuum cleaner 100 according to an embodiment.

The vacuum cleaner 100 according to an embodiment of the present disclosure may be provided with a modular cleaning module 210 that is detachable, and may be used while changing an appropriate cleaning module 210 as necessary.

The cleaner body 200 may receive information and load information indicating which cleaning module was used from the cleaning module 210. For example, a main circuit (MCU: Micro Controller Unit) provided in the cleaner body 200 may determine and store which cleaning module 210 is currently being used through the current value (or voltage value) measured at the power line connected to the cleaning module 210.

Since the current value of the power line may vary depending on the load applied to the cleaning module 210, the main circuit may also store and use the load information or torque information applied to the cleaning module 210. For reference, the torque of the motor is proportional to the load current flowing through the rotor. As the load of the motor increases, the load current increases, and the torque increases to balance with the load so that stable operation can be continued. The relationship between the torque and the load current may be determined through a torque characteristic curve.

In addition, the main circuit may store information regarding which cleaning module 210 was used at what time and for what duration, that is, usage time information. When the usage mode is determined into strong/medium/weak according to the rotational force of the suction motor of the cleaner body 200, the main circuit may store the usage time and usage output for each usage mode used by the user. The main circuit may transmit accumulated usage time and usage frequency information for each cleaning module used by the user to the server 30 together with the information.

The server 30 may provide cleaning history information to the user by using the accumulated information. In addition, the server 30 may inform that a cleaning time has arrived by analyzing a cleaning pattern of the user and recommending a cleaning type necessary to the smart device 20 or the vacuum cleaner 100. For example, when analyzing through the accumulated data of the vacuum cleaner 100, if the time since the last use of a bedding cleaning module exceeds two months, the application of the smart device 20 may inform the user that it is time to perform a bedding cleaning.

In addition, the server 30 may inform that it is time for a washing of the cleaning module 210 component, or that the cleaning module 210 has failed or the replacement time has elapsed.

Figure 7:
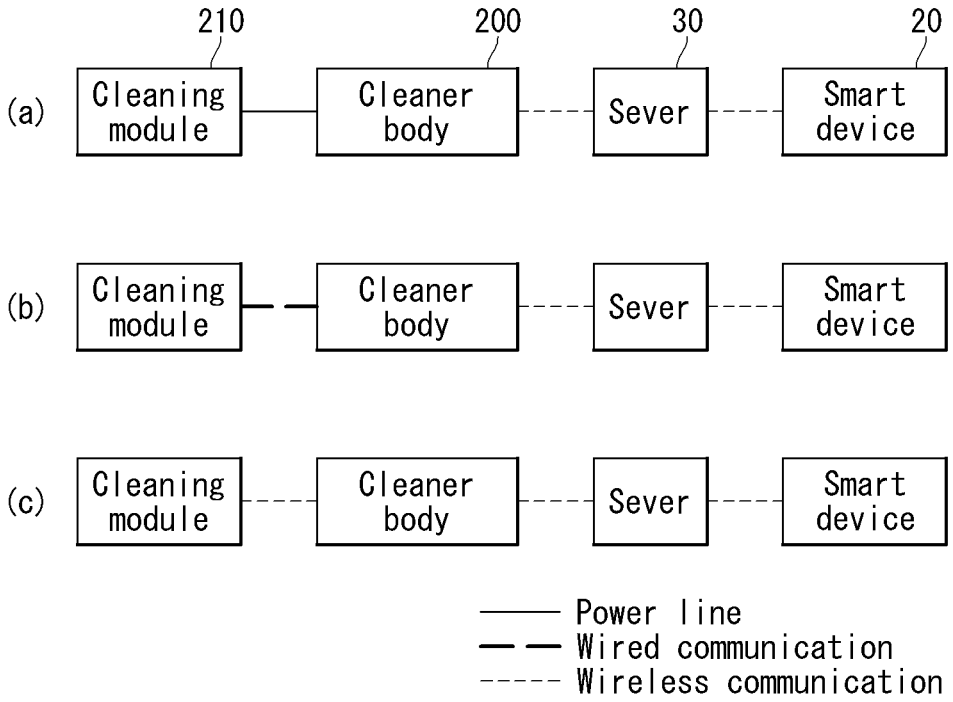
FIG. 7 is a block diagram illustrating a connection relationship of a vacuum cleaner according to an embodiment.

FIG. 7 is a block diagram illustrating a connection relationship of a vacuum cleaner 100. FIG. 7 illustrates a plurality of potential connection relationships (a), (b), and (c), that may be implemented in vacuum cleaner 100.

Referring to connection relationship (a) shown in FIG. 7, the cleaning module 210 and the cleaner body 200 may be physically connected through a power line, the cleaner body 200 and the server 30 may be connected by wireless communication, and the server 30 and the smart device 20 may be connected by wireless communication.

In some embodiments, a coupling part of the cleaning module 210 and the cleaner body 200 may transmit the suction force generated by the cleaner body 200 to the cleaning module 210. The coupling part may include a suction pipe providing a passage for moving dust suctioned from the cleaning module 210, and a power line for providing power to the cleaning module 210.

The main circuit of the cleaner body 200 can obtain information indicating which cleaning module 210 is coupled, whether it is currently in use, and how much load or torque is applied through the current value (or voltage value) of the power line.

Referring to connection relationship (b) shown in FIG. 7, the cleaning module 210 and the cleaner body 200 may be physically connected through a power line and wired communication, the cleaner body 200 and the server 30 may be connected by wireless communication, and the server 30 and the smart device 20 may be connected by wireless communication.

In such embodiments, a coupling part of the cleaning module 210 and the cleaner body 200 may transmit the suction force generated by the cleaner body 200 to the cleaning module 210, and include a suction pipe providing a passage for moving dust suctioned from the cleaning module 210, a power line for providing power to the cleaning module 210, and a communication line for transmitting usage information of the cleaning module 210.

The main circuit of the cleaner body 200 may obtain information related to which cleaning module 210 is coupled, whether it is currently in use, and how much load or torque is applied through the information of the communication line. In some embodiments, he current (or voltage) information transmitted through the power line may include noise. When the noise is relatively large, it may not be possible to accurately identify current (or voltage) information through the power line. In this case, by using a separate communication line, only information to be obtained can be transmitted through a separate line. For example, when a bedding cleaning module is used in combination, it may be difficult to obtain usage information through the power line because the operating current may be very weak. In this case, a communication line is provided separately from the power line, thus allowing the cleaning module to transmit information through the communication line without missing information.

Referring to connection relationship (c) shown in FIG. 7, the cleaning module 210 and the cleaner body 200 may be physically connected through the power line and may be connected through wireless communication, the cleaner body 200 and the server 30 may be connected by wireless communication, and the server 30 and the smart device 20 may be connected by wireless communication.

The cleaning module 210 may be provided with a transmitter for wirelessly transmitting the usage information. The cleaner body 200 may be provided with a receiver for receiving information of the cleaning module 210.

Figure 8:
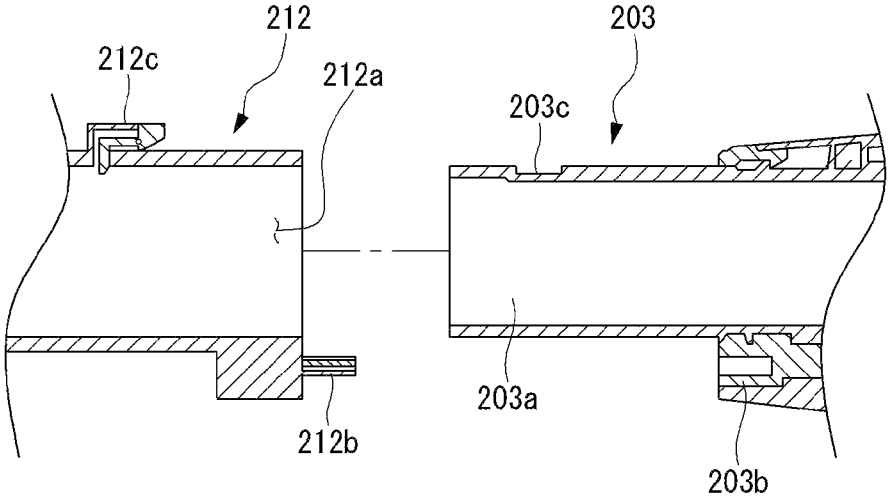
FIG. 8 is a cross-sectional view illustrating a coupling part of a cleaner body and a cleaning module according to a first embodiment.
Figure 9:
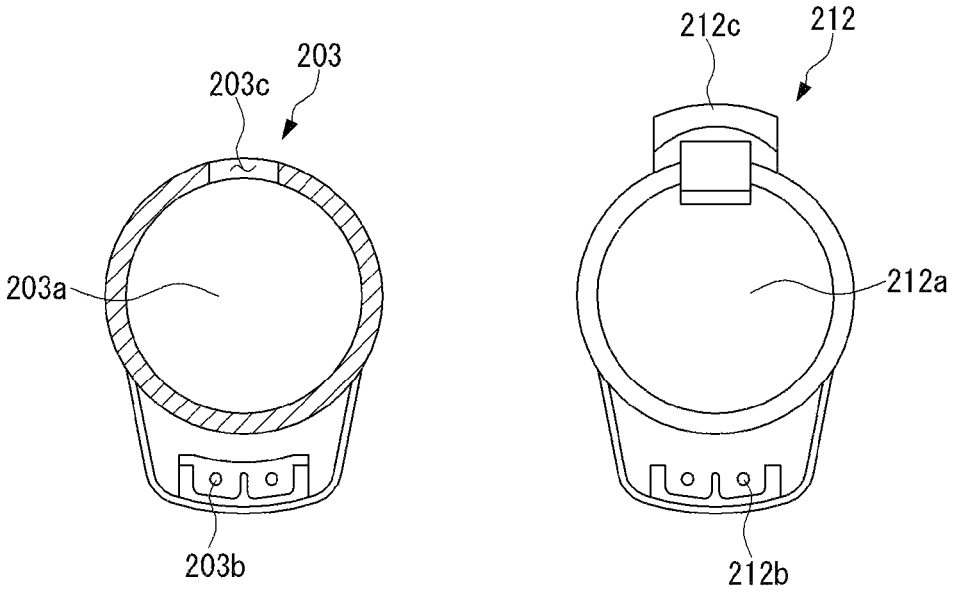
FIG. 9 is a plan view illustrating coupling parts of a cleaner body and a cleaning module according to a first embodiment, respectively.

In addition, the main circuit of the cleaner body 200 can obtain information related to which cleaning module 210 is coupled, whether it is currently in use, and how much load is applied through the information of the receiver. Zigbee, Bluetooth, or the like are example means of wireless communication that may be used FIG. 8 is a cross-sectional view illustrating an example coupling part of a cleaner body 200 and a cleaning module 210 according to a first embodiment, and FIG. 9 is a plan view illustrating coupling parts of a cleaner body 200 and a cleaning module 210 according to a first embodiment, respectively.

The cleaner body 200 may form the connecting part 203 which is connected to the front of the body part 201 and is coupled to the cleaning module 210 or the length adjusting member 220. The connecting part 203 may be provided in a form of a tube protruding in front of the body part 201.

In addition, one end of the cleaning module 210 or the length adjusting member 220 may be formed with a coupling part 212 coupled to the connecting part 203. The coupling part 212 may be provided in a tubular shape in which the connecting part 203 may be accommodated. Accordingly, the inner diameter of the coupling part 212 may be the same or slightly larger than the outer diameter of the connecting part 203.

In some embodiments, the connecting part 203 and the coupling part 212 may be detachably coupled. For example, a coupling groove 203*c* may be formed as a recess in an outer circumferential surface of the connecting part 203 and a coupling protrusion 212*c* may be formed to protrude from an inner circumferential surface of the coupling part 212.

The coupling protrusion 212*c* may be connected to the coupling part 212 by a hinge, and supported by an elastic member such as a coil spring. That is, when the user inserts the connecting part 203 into the inner space of the coupling part 212, the coupling protrusion 212*c* may be pressed while pressing the elastic member, and when the insertion of the connecting part 203 is completed, the coupling protrusion 212*c* may be fitted into the coupling groove 203*c* by a restoring force of the elastic member. Therefore, the connecting part 203 and the coupling part 212 can be firmly coupled.

To separate the connecting part from the coupling part, a button provided on the outer circumferential surface of the coupling part 212 may be used. When the user presses the button, the coupling protrusion 212*c* connected thereto may be moved into a state in which the elastic member is pressed. That is, the coupling protrusion 212*c* may be separated from the coupling groove 203*c* to separate the connecting part 203 from the coupling part 212.

The connecting part 203 may transmit a suction force generated in the cleaner body 200 to the cleaning module 210, and may include a first suction pipe 203*a* forming a passage through which dust suctioned from the cleaning module 210 may move, and a first power connection part 203*b* for providing power to the cleaning module 210.

In addition, the coupling part 212 may be provided with a second suction pipe 212*a* providing a passage through which the suction force of the connecting part 203 is transmitted and a passage through which dust suctioned by the cleaning module 210 moves, and a second power connection part 212*b* for receiving power from the first power connection part 203*b*.

The first and second power connection parts 203*b* and 212*b* may be provided at one side of the first and second suction pipes 203*a* and 212*a* in a shape in which two terminals are connected. For example, the second power connection part 212*b* may be provided so that the positive terminal protrudes, and the first power connection part 203*b* may be provided so that the negative terminal is recessed, and the second power connection part 212*b* may be inserted.

That is, the suction pipes 203*a* and 212*a* and the power connection parts 203*b* and 212*b* may be simultaneously connected while the connecting part 203 and the coupling part 212 are coupled to each other.

Figure 10:
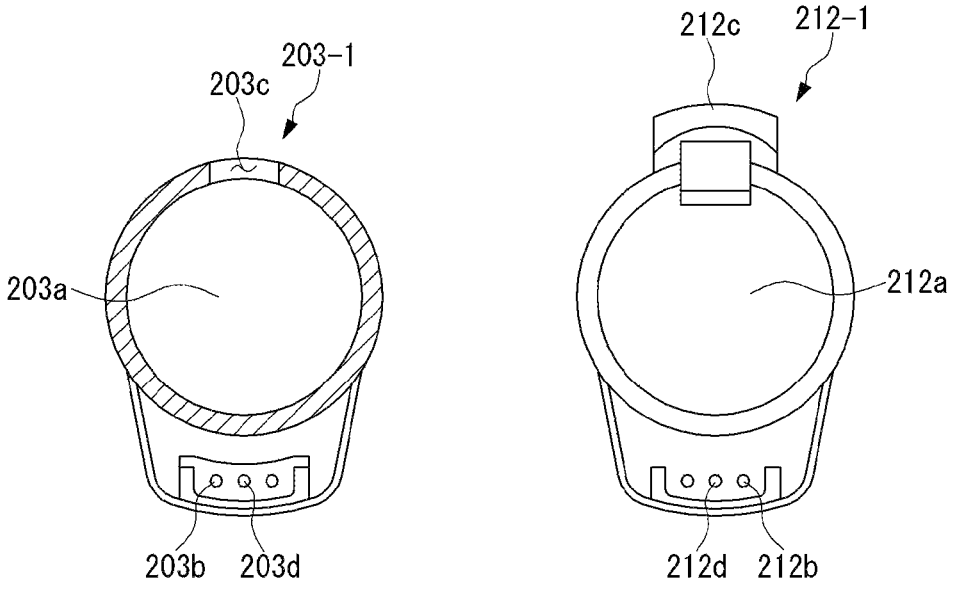
FIG. 10 is a plan view illustrating a coupling part of a cleaner body and a cleaning module according to a second embodiment, respectively.

FIG. 10 is a plan view illustrating a coupling part of a cleaner body 200 and a cleaning module 210 according to a second embodiment, respectively.

The connecting part 203 may be provided with a first suction pipe 203*a* defining a passage through which the suction force generated in the cleaner body 200 is transmitted to the cleaning module 210 and through which the dust suctioned in the cleaning module 210 moves, a first power connection part 203*b* for providing power to the cleaning module 210, and a first information connection part 203*d* which is connected to a second information connection part 212*d* described below to receive information.

The coupling part 212 may be provided with a second suction pipe 212*a* forming a passage through which the suction force of the connecting part 203 is transmitted and dust suctioned from the cleaning module 210 moves, a second power connection part 212*b* for receiving power from the first power connection part 203*b*, and a second information connection part 212*d* which transmits the information of the cleaning module 210 to the main circuit of the cleaner body 200.

The first and second power connection parts 203*b* and 212*b* may be provided at one side of the first and second suction pipes 203*a* and 212*a* in a shape in which two terminals are connected. For example, the second power connection part 212*b* may be provided so that the positive terminal protrudes, and the first power connection part 203*b* may be provided so that the negative terminal is recessed, and the second power connection part 212*b* may be inserted.

In addition, the first and second information connection parts 203*d* and 212*d* may be provided adjacent to the first and second power connection parts 203*b* and 212*b*, and may be provided in a shape to which one terminal is connected. For example, the second information connection part 212*d* may be provided so that one terminal protrudes, and the first information connection part 203*d* may be provided so that the negative terminal is recessed, and the second power connection part 212*d* may be inserted.

Accordingly, the suction pipes 203*a* and 212*a*, the power connection parts 203*b* and 212*b*, and the information connection parts 203*d* and 212*d* may be simultaneously connected when the connecting part 203 and the coupling part 212 are coupled to each other.

Hereinafter, a method of providing customized cleaning information using a vacuum cleaner according to an embodiment of the present disclosure will be described.

Figure 11:
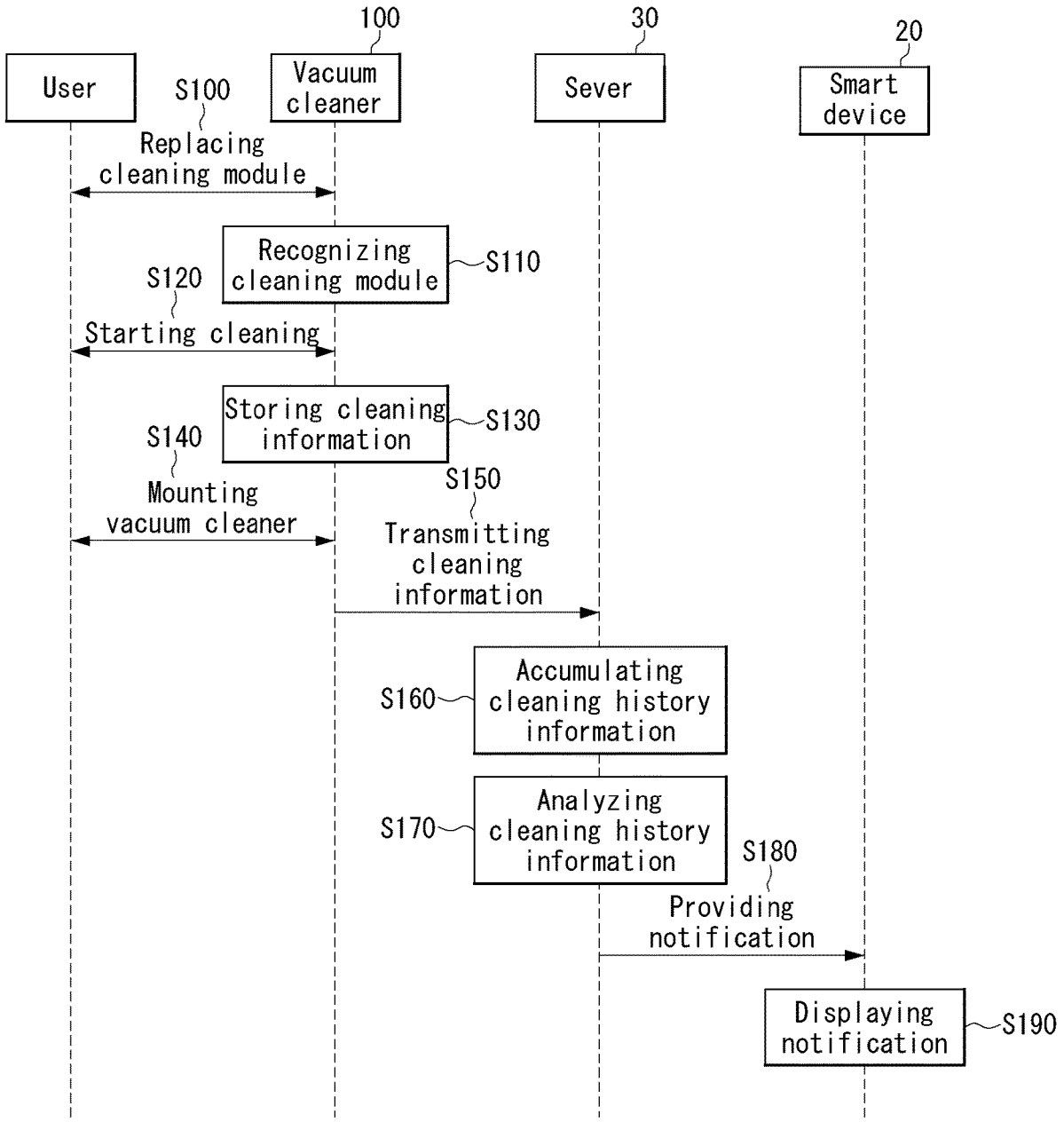
FIG. 11 is a block diagram illustrating a method of providing customized cleaning information according to a first embodiment in order of time.

FIG. 11 is a block diagram illustrating a method of providing customized cleaning information according to a first embodiment in order of time.

The vacuum cleaner 100 may include a modular cleaning module 210 having various functions, and may be configured to perform various functions in combination with the modular cleaning module 210.

Referring to FIG. 11, the user may combine the cleaning module 210 of the vacuum cleaner 100 as necessary (S100). In the memory 105 (see FIG. 3) of the vacuum cleaner 100. Information of available cleaning modules may be stored in advance. For example, the cleaning module 210 may include a cleaning module having a basic wood floor suction port, a cleaning module having a bedding suction port, a cleaning module having a mattress suction port, a cleaning module having a carpet suction port, a cleaning module having a mop, etc. In addition, a dedicated cleaning module for performing various functions, such as for difficult to remove dust, narrow gaps, or cleaning raised objects may be provided as a module.

Next, the processor 101 (see FIG. 3) of the vacuum cleaner 100 may recognize and specify which of the cleaning modules stored in the memory 105 corresponds to the combined cleaning module 210 (S110). In some embodiments, although shown in FIG. 11 as being performed by vacuum cleaner 100, the step of recognizing the cleaning module may be performed in the server 30. In this case, the server may recognize and specify the cleaning module after a cleaning information transmission step S150, described in further detail below.

When the user begins cleaning using the vacuum cleaner 100 (S120), information received from the sensing unit 104 (see FIG. 3) of the vacuum cleaner 100 is stored in the memory 105 (S130). When the user mounts the vacuum cleaner 100 on the holder (S140), the processor 101 may transmit information to the server 30 through the communication module 106 (S150).

The cleaning-related information transmitted from the vacuum cleaner 100 to the server 30 may include a type of the cleaning module 210 executed, a driving start time and end time of the vacuum cleaner 100, a duration in which the vacuum cleaner 100 is driven, a usage mode selected in the vacuum cleaner, load information applied to the vacuum cleaner 100, contamination information of the vacuum cleaner 100 or the cleaning module 210, or remaining battery information.

The server 30 may accumulate and store information transmitted from the vacuum cleaner 100 (S160). For example, the server 30 may store the usage history of the vacuum cleaner 100 as data. The server 30 may determine and store information for each cleaning module 210.

The server 30 may analyze the cleaning history information through the accumulated data (S170). For example, the server 30 may derive information useful to the user by analyzing information related to the cleaning module 210, such as whether the cleaning module should be used (e.g., when a time since last usage exceeds a time threshold), whether the cleaning module 210 needs to be washed or replaced (e.g., when an accumulated usage time exceeds a threshold), a remaining life of the battery, or other information.

In addition, the server 30 may provide a notification to the smart device 20 in which the application ("app") synchronized with the vacuum cleaner 100 is stored (S180). For example, the server 30 may provide a notification that a cleaning time of an object to be cleaned using the corresponding cleaning module 210 has arrived when a predefined time has passed since the specific cleaning module 210 has been used. Alternatively, the server 30 may provide a notification that a cleaning module 210 needs to be washed or cleaned when a threshold time since a last washing or cleaning of a specific cleaning module 210 is exceeded, or a notification that the cleaning module 210 needs to be replaced or repaired because when an accumulated usage time of a specific cleaning module 210 since the first time the cleaning module is used exceeds a usage time threshold. Alternatively, the server 30 may provide a notification that a replacement is necessary because the remaining life of the battery is short.

Figure 12:
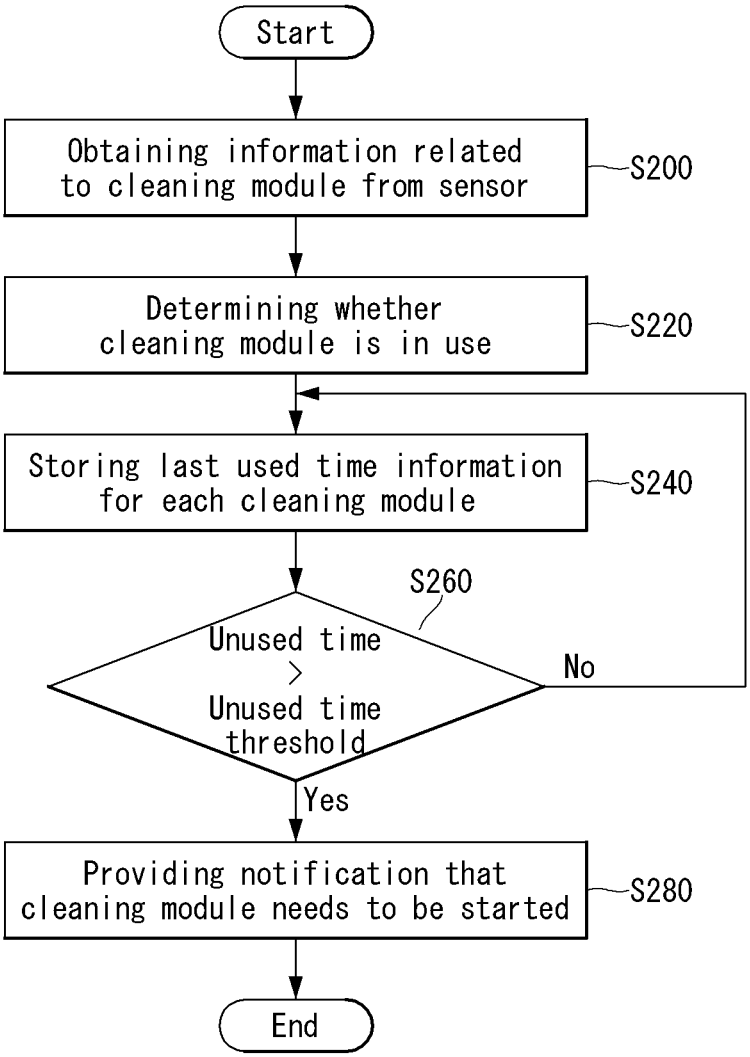
FIG. 12 is a flowchart illustrating a method of providing customized cleaning information according to a first embodiment.

FIG. 12 is a flowchart illustrating a method of providing customized cleaning information according to a first embodiment.

A method of providing customized cleaning information according to the first embodiment starts by obtaining information related to the cleaning module 210 from the sensor of the vacuum cleaner 100 (S200).

The vacuum cleaner 100 may determine and specify whether the cleaning module 210 is in use by using the obtained information (S220). Alternatively, the server 30 receiving the information from the vacuum cleaner 100 may perform a task of determining the cleaning module 210.

The vacuum cleaner 100 may store last used time information of the specified cleaning module 210 (S240). In this step, the last used time information for each cleaning module 210 may be stored.

The server 30 may calculate an unused time by comparing a last used time of the cleaning module 210 and a current time, and determine whether the unused time is greater than an unused time threshold by comparing it with the unused time threshold (S260). Alternatively, the determination may be performed by a processor in the vacuum cleaner 100.

When the unused time of the specific cleaning module 210 is greater than the unused time threshold, the server 30 may provide a notification that the cleaning module 210 needs to be used (S280). The notification may be transmitted to the vacuum cleaner 100, or may be transmitted to the smart device 20 in which the application linked with the vacuum cleaner 100 is stored.

Accordingly, the user may be informed that it is time to clean a specific object through the notification. For example, if the unused time threshold for the bedding cleaning module is 30 days, and if 30 days have passed since the last time the bedding cleaning module is used, the smart phone may provide a notification that "30 days have passed since the last bedding cleaning. Start cleaning the bedding!".

Figure 13:
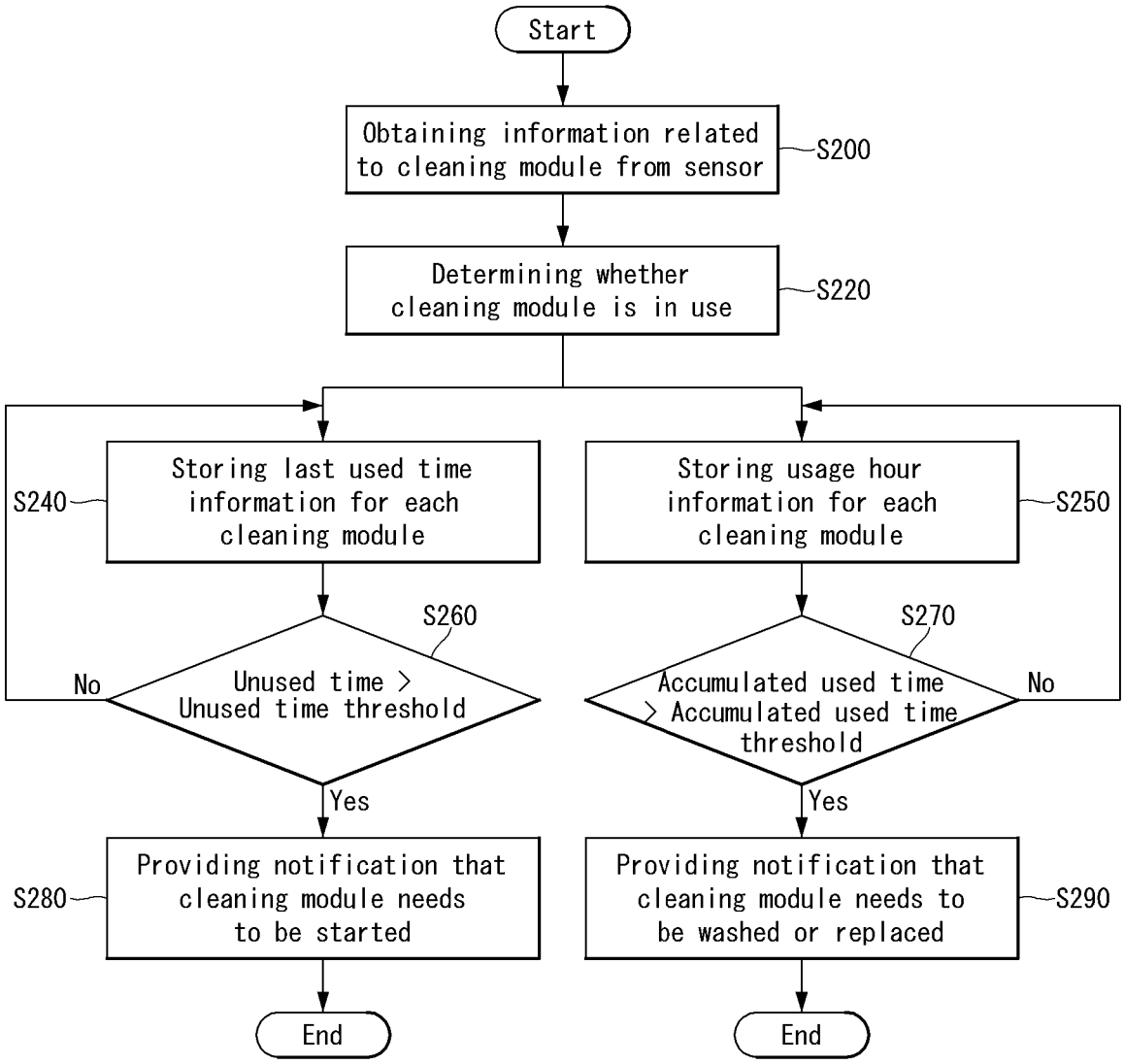
FIG. 13 is a flowchart illustrating a method of providing customized cleaning information according to a second embodiment.

FIG. 13 is a flowchart illustrating a method of providing customized cleaning information according to a second embodiment.

In the method of providing customized cleaning information according to the second embodiment, additional notification information may be added as compared with the first embodiment described with reference to FIG. 12. The description of the steps overlapping with the first embodiment will be omitted.

The method of providing customized cleaning information according to the second embodiment starts by obtaining information related to the cleaning module 210 from the sensor of the vacuum cleaner 100 (S200).

The vacuum cleaner 100 may determine and specify whether the cleaning module 210 is in use by using the obtained information (S220). Alternatively, the server 30 receiving the information from the vacuum cleaner 100 may perform a task of determining the cleaning module 210.

The vacuum cleaner 100 stores last used time information of the specified cleaning module 210 (S240). At this time, the last used time information for each cleaning module 210 may be stored.

The server 30 may calculate total accumulated usage time by adding the use time of the cleaning module 210 each time it is transmitted to a use time of the cleaning module 210 accumulated so far, and may determine whether an accumulated usage time is greater than a usage time threshold by comparing it with the usage time threshold (S270). Alternatively, the determination may be performed by a processor in the vacuum cleaner 100.

When the accumulated usage time of the specific cleaning module 210 is greater than the usage time threshold, the server 30 may provide a notification that the cleaning module 210 needs to be washed or replaced (S290). The notification may be transmitted to the vacuum cleaner 100, or may be transmitted to the smart device 20 in which the application linked with the vacuum cleaner 100 is stored.

The user may be informed that it is time to wash or replace the specific cleaning module 210 through the notification. For example, if the usage time threshold for cleaning the bedding cleaning module may be 360 minutes, and if 360 minutes have passed since the last time the bedding cleaning module is cleaned, the smart phone may provide a notification that "washing of the bedding cleaning module 210 is required". Alternatively, if the usage time threshold for replacing the bedding cleaning module is 3600 minutes, and if 3600 minutes have passed since the first time the bedding cleaning module was used, the smart phone may provide a notification that "replacement of the bedding cleaning module 210 is required".

Figure 14:
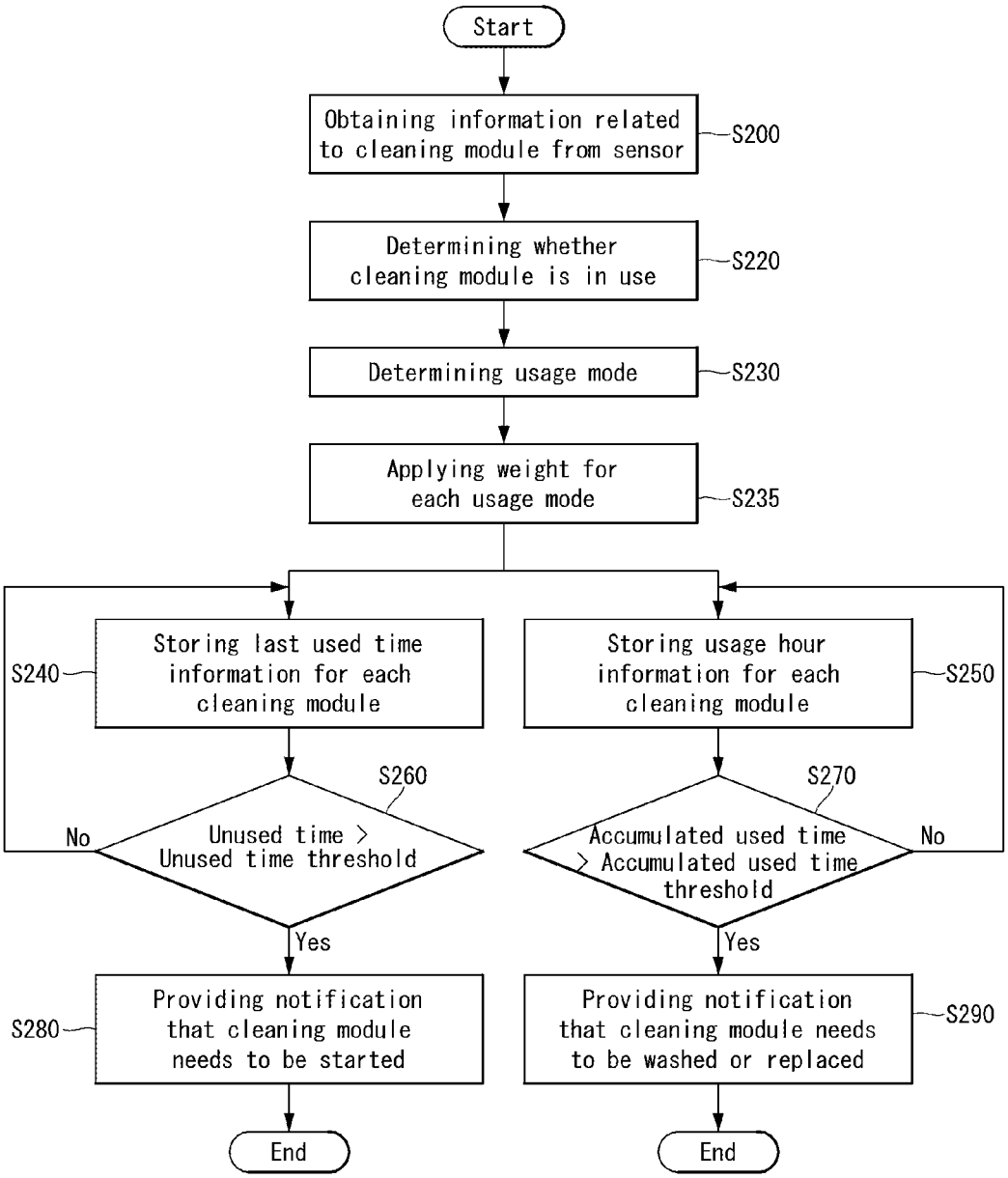
FIG. 14 is a flowchart illustrating a method of providing customized cleaning information according to a third embodiment.

FIG. 14 is a flowchart illustrating a method of providing customized cleaning information according to a third embodiment.

In the method of providing customized cleaning information according to the third embodiment, various steps may be added as compared with the second embodiment described with reference to FIG. 13. The description of the steps overlapping with the second embodiment will be omitted.

The method of providing customized cleaning information according to the third embodiment starts by obtaining information related to the cleaning module 210 from the sensor of the vacuum cleaner 100 (S200).

The vacuum cleaner 100 may determine and specify whether the cleaning module 210 is in use by using the obtained information (S220). Alternatively, the server 30 receiving the information from the vacuum cleaner 100 may perform a task of determining the cleaning module 210.

In addition, the vacuum cleaner 100 may determine and store usage modes of the cleaning module 210 (S230). For example, a usage mode may be classified as strong/medium/weak according to the rotational force of the suction motor of the cleaner body 200.

The vacuum cleaner 100 may convert the cleaning information data by applying a weight for each usage mode. For example, the strong mode may be given a weight of 3, the medium mode may be given a weight of 2, and the weak mode may be given a weight of 1, and by multiplying a weight corresponding to a total usage time in each usage mode, a new total usage time may be derived to reflect the time in each usage mode.

The vacuum cleaner 100 may store the last used time and usage duration information reflecting the weight in the specified cleaning module 210 (S240, S250).

The subsequent steps are the same as described above with respect to FIG. 13.

Figure 15:
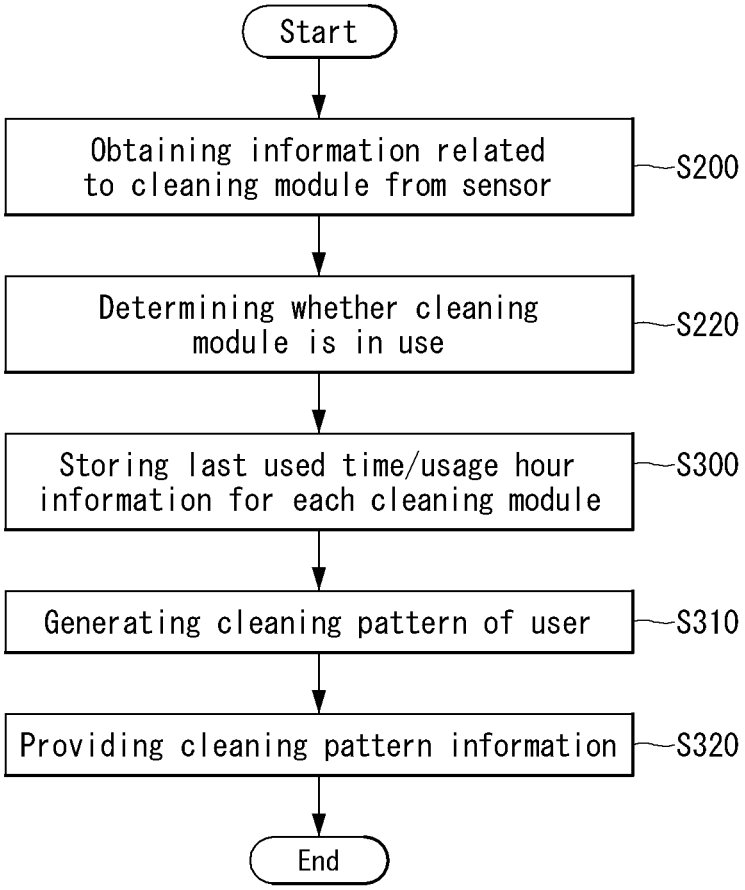
FIG. 15 is a flowchart illustrating a method of providing customized cleaning information according to a fourth embodiment.

FIG. 15 is a flowchart illustrating a method of providing customized cleaning information according to a fourth embodiment.

The method of providing customized cleaning information according to the fourth embodiment starts by obtaining information related to the cleaning module 210 from the sensor of the vacuum cleaner 100 (S200).

The vacuum cleaner 100 may determine and specify whether the cleaning module 210 is in use by using the obtained information (S220). Alternatively, the server 30 receiving the information from the vacuum cleaner 100 may perform a task of determining the cleaning module 210.

The vacuum cleaner 100 may store last used time information and usage duration information of the specified cleaning module 210 (S300). At this time, the last used time information and usage duration information for each cleaning module 210 may be stored.

The server 30 may generate a cleaning pattern of the user by using the last used time information and the usage duration information for each cleaning module 210 (S310). For example, based on the recorded cleaning information of the user, a cleaning pattern, which leads to floor cleaning, then bedding cleaning, then mattresses cleaning, and finally mop cleaning, can be generated. Alternatively, the determination may be performed by a processor in the vacuum cleaner 100.

The server 30 may provide the user with information related to this cleaning pattern (S320). For example, the server 30 may determine the location of the cleaning step currently in progress in the cleaning pattern, and may provide the user with information related to the next object or surface to be cleaned and/or the cleaning module 210 that may be used. The notification may be transmitted to the vacuum cleaner 100, or may be transmitted to the smart device 20 in which the application linked with the vacuum cleaner 100 is stored.

The user may intentionally proceed with the cleaning through the notification, and prevent the cleaning steps from being mixed or avoid accidentally missing some cleaning steps.

Some embodiments or other embodiments of the present disclosure described above are not mutually exclusive or distinct from one another. Some embodiments or other embodiments of the present disclosure described above may be used in combination with or combined with each configuration or function.

For example, it means that configuration A described in specific embodiments and/or drawings and configuration B described in other embodiments and/or drawings may be combined. In other words, even when the combination between the configurations is not described directly, it means that the combination is possible except when it is described that the combination is impossible.

The above detailed description should not be construed as limiting in all respects but should be considered as illustrative. The scope of the present disclosure should be determined by reasonable interpretation of the appended claims, and all changes within the equivalent scope of the present disclosure are included in the scope of the present disclosure.

What is claimed is:

1. A method of providing customized cleaning information, the method comprising:

obtaining, by one or more processors, information related to a cleaning module from a sensor of a vacuum cleaner, the vacuum cleaner including a driver configured to transmit a suction force to a cleaning module;

determining, by the one or more processors, whether the cleaning module is in use from among pre-registered cleaning modules based on the information related to the cleaning module;

storing, by the one or more processors, last used time information of the cleaning module based on the information related to the cleaning module;

obtaining, by the one or more processors, current time information;

comparing, by the one or more processors, the last used time information with the current time information to determine whether an unused time of the cleaning module exceeds an unused time threshold specified for the cleaning module;

providing, by the one or more processors, an indication that the cleaning module needs to be used when the unused time of the cleaning module exceeds the unused time threshold;

separately storing, by the one or more processors, last used time information for a plurality of usage modes of the cleaning module based on the information related to the cleaning module;

applying, by the one or more processors, a weight for each usage mode of the cleaning module to each of the last used time information for the plurality of usage modes of the cleaning module stored separately;

storing, by the one or more processors, the last usage time information applied with the weight; and transmitting, by the one or more processor, a control command to the vacuum cleaner and controlling an operation of the driver according to the control command, the control command being based on the last usage time information applied with the weight.

2. The method of claim 1, wherein the information related to the cleaning module includes information related to at least one of a current, a voltage, a load current, or a torque.

3. The method of claim 1, further comprising:

storing usage time information of the cleaning module based on the information related to the cleaning module;

determining, based on the usage time information, whether an accumulated usage time of the cleaning module exceeds a usage time threshold specified for the cleaning module; and providing an indication that the cleaning module needs maintenance when the accumulated usage time of the cleaning module exceeds the usage time threshold.

4. The method of claim 3, wherein the usage time threshold includes timing information indicating a timing at which the cleaning module needs to be washed, and the information indicating that the cleaning module needs maintenance includes the timing information.

5. The method of claim 3, wherein the usage time threshold includes timing information indicating a timing at which the cleaning module needs to be replaced, and the information indicating that the cleaning module needs maintenance includes the timing information.

6. The method of claim 5, wherein the information indicating that the cleaning module needs maintenance includes at least one of a purchase list or a purchase site link corresponding to the cleaning module.

7. The method of claim 3, further comprising:

generating a cleaning pattern of a user through the last used time information and the usage time information; and providing the generated cleaning pattern, wherein the cleaning pattern includes scheduling and operating time information of cleaning modules that need to be used.

8. The method of claim 7, wherein the cleaning pattern includes a list and order information of the cleaning modules that need to be used.

9. The method of claim 1, further comprising:

generating a cleaning pattern of a user using the last used time information of the cleaning module; and providing the generated cleaning pattern.

10. The method of claim 1, further comprising:

displaying, on a display of a smart device, information indicating that the cleaning module needs to be started, the smart device being configured to store an application linked to the vacuum cleaner.

11. A vacuum cleaner configured to be combined with modular cleaning modules, the vacuum cleaner comprising:

a driver configured to transmit a suction force to a cleaning module in use;

a sensor configured to obtain sensor information indicating at least one of current, voltage, load, or torque for the cleaning module;

a memory configured to store information regarding pre-registered cleaning modules and last used time information of the cleaning module;

a processor configured to identify the cleaning module by comparing the information regarding pre-registered cleaning modules with the sensor information;

a first wireless transmitter configured to transmit information related to the identified cleaning module to a server; and a usage mode selection unit configured to provide a plurality of usage modes that vary the suction force of the driver, wherein the memory is further configured to store usage time information for each usage mode for the cleaning module in use, wherein the transmitted information related to the identified cleaning module includes the usage time information for each usage mode, and wherein the processor is further configured to:

convert the usage time information by applying a weight for each usage mode to generate converted information; and transmit the converted information to the first wireless transmitter.

12. The vacuum cleaner of claim 11, further comprising:

a receiver configured to receive, from the server, information indicating a cleaning module that needs to be started; and an output unit including at least one of a display or a speaker configured to provide the information indicating the cleaning module that needs to be started.

13. The vacuum cleaner of claim 11, further comprising:

a cleaner body comprising a connecting part detachably coupled to the cleaning module, wherein the connecting part includes:

a suction line configured to provide suction pressure to the cleaning module, and a second power supply line configured to be connected to a first power supply line of the cleaning module and supply power, wherein the sensor is connected to the second power supply line to obtain information on the current supplied.

14. The vacuum cleaner of claim 11, further comprising:

a cleaner body configured to be provided with a connecting part detachably coupled to the cleaning module, wherein the connecting part includes:

a suction line configured to provide suction pressure to the cleaning module, a second power supply line configured to be connected to a first power supply line of the cleaning module and supply power, and a second communication line configured to be connected to a first communication line of the cleaning module and receive information of the cleaning module.

15. The vacuum cleaner of claim 11, further comprising:

a cleaner body configured to be provided with a connecting part detachably coupled to the cleaning module, a second wireless transmitter provided in the cleaning module and configured to transmit information associated with the cleaning module, and a second wireless receiver provided in the cleaner body and configured to receive information of the second wireless transmitter, wherein the connecting part includes:

a suction line configured to provide suction pressure to the cleaning module, and a second power supply line configured to be connected to a first power supply line of the cleaning module and supply power.

16. A method of providing customized cleaning information associated with a vacuum cleaner having modular cleaning modules and a smart device on which an application linked to the vacuum cleaner is installed, the method comprising:

obtaining, by one or more processors, information related to a cleaning module from a sensor of the vacuum cleaner, the vacuum cleaner including a driver configured to transmit a suction force to the cleaning module, transmitting, by the one or more processors, the information to a server through a transmitter, determining, by the one or more processors, whether the cleaning module is in use from among pre-registered cleaning modules based on the information related to the cleaning module, storing, by the one or more processors, last used time information of the cleaning module based on the information related to the cleaning module, obtaining, by the one or more processors, current time information, comparing, by the one or more processors, the last used time information with the current time information to determine whether unused time of the cleaning module exceeds an unused time threshold specified for the cleaning module, providing, by the one or more processors, to the smart device, an indication that the cleaning module needs to be used when the unused time exceeds the unused time threshold, separately storing, by the one or more processors, last used time information for a plurality of usage modes of the cleaning module based on the information related to the cleaning module, applying, by the one or more processors, a weight for each usage mode of the cleaning module to each of the last used time information for the plurality of usage modes of the cleaning module stored separately, storing, by the one or more processors, the last usage time information applied with the weight; and transmitting, by the one or more processor, a control command to the vacuum cleaner and controlling an operation of the driver according to the control command, the control command being based on the last usage time information applied with the weight.

* * * * *